US005979370A

United States Patent [19]

Franke

[11] Patent Number: 5,979,370

[45] Date of Patent: Nov. 9, 1999

[54] CONTINUOUS-FLOW STEAM GENERATOR

[75] Inventor: Joachim Franke, Altdorf, Germany

[73] Assignee: Siemens Aktiengesellschaft, Munich, Germany

[21] Appl. No.: 08/810,357

[22] Filed: Mar. 3, 1997

Related U.S. Application Data

[63] Continuation of application No. PCT/DE95/01103, Aug. 21, 1995.

[30] Foreign Application Priority Data

Sep. 1, 1994 [DE] Germany ..... 44 31 185

[51] Int. Cl.[6] ..... F22B 37/12

[52] U.S. Cl. ..... 122/235.14; 122/6 A

[58] Field of Search ..... 122/6 A, 235.12, 122/235.14, 367.1, 367.3, 511

[56] References Cited

U.S. PATENT DOCUMENTS

| | | | |
|---|---|---|---|
| 1,854,342 | 4/1932 | Lundgren et al. . | |
| 3,375,628 | 4/1968 | Connell et al. | 122/6 A |
| 4,926,799 | 5/1990 | Wittchow | 122/6 A |
| 5,347,955 | 9/1994 | Wittchow | 122/6 A |
| 5,390,631 | 2/1995 | Albrecht | 122/6 A |
| 5,662,070 | 9/1997 | Kastner et al. | 122/6 A |

FOREIGN PATENT DOCUMENTS

| | | |
|---|---|---|
| 0 503 116 A1 | 9/1992 | European Pat. Off. . |
| 429 171 | 5/1926 | Germany . |
| 1 551 007 | 1/1970 | Germany . |
| 30 28 240 | 2/1981 | Germany . |
| 1008768 | 11/1965 | United Kingdom . |
| 1152340 | 5/1969 | United Kingdom . |

OTHER PUBLICATIONS

"Steam Generator Concepts for Benson Steam Generators" (Franke et al.), VGB Kraftwerkstechnik 73, 1993, vol. 4, pp. 352–361.

*Primary Examiner*—Teresa J. Walberg
*Assistant Examiner*—Gregory A. Wilson
*Attorney, Agent, or Firm*—Herbert L. Lerner; Laurence A. Greenberg

[57] ABSTRACT

A continuous-flow steam generator includes a combustion chamber of rectangular cross-section and combustion-chamber walls each having essentially vertically disposed evaporator tubes through which a flow medium can flow from the bottom towards the top. The tubes are connected to one another in a gas-tight manner by tube webs. In order to equalize a differing supply of heat into the evaporator tubes, a heat-absorbing surface formed from an individual evaporator tube and from the tube web assigned to that tube is smaller in the case of evaporator tubes in a middle region of the combustion-chamber wall than at a corner of the combustion chamber.

10 Claims, 4 Drawing Sheets

CONTINUOUS-FLOW STEAM GENERATOR

CROSS-REFERENCE TO RELATED APPLICATION

This application is a Continuation of International Application Ser. No. PCT/DE95/01103, filed Aug. 21, 1995.

BACKGROUND OF THE INVENTION

FIELD OF THE INVENTION

The invention relates to a continuous-flow steam generator including a combustion chamber of rectangular cross-section with combustion-chamber walls each having essentially vertically disposed evaporator tubes which are connected to one another in a gas-tight manner by tube webs and through which a flow medium can flow from the bottom towards the top.

In contrast to a natural-circulation steam generator with only partial evaporation of the circulated water-water/steam-mixture, in a continuous-flow steam generator the heating of evaporator tubes forming the combustion-chamber walls leads to a complete evaporation of the flow medium in the evaporator tubes in one passage. Whereas, in a natural-circulation steam generator, the evaporator tubes are disposed basically vertically, the evaporator tubes of the continuous-flow or forced flow steam generator can be disposed both vertically and helical, and therefore at an inclination.

A continuous-flow steam generator having combustion-chamber walls which are constructed from vertically disposed evaporator tubes is more cost-effective to produce than a continuous-flow steam generator having helical tubing. Moreover, continuous-flow steam generators with vertical tubing have lower water-side/steam-side pressure losses than those with inclined evaporator tubes. However, the unavoidable differences in the supply of heat to the individual vertically disposed evaporator tubes can lead to temperature differences between adjacent evaporator tubes, particularly at the outlet of the evaporator.

Since the magnitude of the heat flow and therefore the introduction of heat into an individual evaporator tube depend on its position in the combustion-chamber wall, in the case of a combustion chamber having vertical tubing, an evaporator tube in a corner of the rectangular combustion chamber or combustion-chamber containment experiences a lower gas-side heat-flow density over its entire length than an evaporator tube in the middle of a combustion-chamber wall. The reason for that is that a flame body occurring within the combustion chamber during the combustion of a fossil fuel does not fill the en tire available space uniformly. Thus, there arises within the combustion chamber a temperature profile which is approximately bell-shaped both in the vertical and in the horizontal direction and which, starting from the middle region of the combustion chamber, decreases both upwards and downwards and towards the corners of the combustion chamber. That results in an increased supply of heat into the evaporator tubes in the middle of the combustion-chamber walls in comparison with the evaporator tubes in the region of the corners of the combustion chamber. That in turn hinders the water-side/steam-side cooling of the evaporator tubes in the middle region of the combustion-chamber walls. That can lead to inadmissibly high steam temperatures at the outlet of the evaporator tubes. Additionally, as a result of the high heat-flow density, the temperature of the tube webs in the middle of the combustion-chamber walls can assume inadmissibly high values.

Inadmissibly high temperature differences between adjacent tubes can be avoided in the vertical direction of the combustion chamber by a drastic reduction in the pressure loss attributable to friction. The reduction itself is achieved through the use of a corresponding lowering of the flow velocity or of the mass flow density in the evaporator tubes. For that purpose, however, it is necessary to use internally ribbed evaporator tubes, since they have particularly good properties of heat transmission even at low mass flow densities. Evaporator tubes of that type, with ribs forming multiple threads on their inside, and their use in steam generators are known, for example, from Published European Patent Application 0 503 116 A1.

In the case of tubing of the combustion-chamber walls of a continuous-flow steam generator with internally ribbed evaporator tubes, the axial flow has a swirl superposed on it which leads to a phase separation of the heat-absorbing medium with a water film on the inner wall of the tube. As a result, the very good heat transmission in boiling can be maintained almost up to the complete evaporation of the water. However, in the pressure range of between 200 bar and 221 bar, under strong heating, inadmissibly high wall temperatures cannot always be avoided through the use of a swirl flow alone. In the vicinity of the critical pressure of around approximately 210 bar, where there is still only a small density difference between a liquid-like and steam-like medium, the wetting of the inner wall or heating surface of the tube is substantially more difficult to guarantee than in a pressure range which is below 200 bar. That is because a steam film forming between the tube wall and the liquid phase of the heat-absorbing medium impedes the heat transmission (film boiling). In that range of steam-film formation, the temperature of the tube wall rises sharply. As is described in the paper entitled "Verdamferkonzepte fur Benson-Damferzeuger" [Evaporator Concepts for Benson Steam Generators] by J. Franke, W. Kohler and E. Wittchow, published in VGB Kraftwerkstechnik 73 (1993), No. 4, pages 352 to 360, above a pressure of around 210 bar even slight wall overheating is sufficient to pass from the boiling-state with a wetted heating surface to film boiling with a non-wetted heating surface. Additionally, in the pressure range mentioned, even when slight overheating occurs, steam bubbles can form in the overheated boundary layer, and they combine to form large bubbles and thus impede the heat transmission (homogeneous nucleation).

The result of the heat transmission mechanism described is that, in the tubes of continuous-flow steam generators which are operated at pressures of approximately 200 bar and above, the mass flow density, and therefore the pressure loss attributable to friction, must be selected to be higher than in continuous-flow steam generators, which are operated at pressures of below 200 bar. That does away with the advantage that, in the case of extra heating of individual tubes, their through-put also rises. However, since high steam pressures of more than 200 bar are required in order to achieve high thermal efficiencies and therefore low emissions of carbon dioxide, it is necessary, in that pressure range too, to ensure good heat transmission. Continuous-flow steam generators with combustion-chamber walls having vertical tubing are therefore conventionally operated with relatively high mass flow densities in the evaporator tubes, in order to always achieve a sufficiently high heat transmission from the evaporator tube wall to the flow medium or heat-absorbing medium, in the critical pressure range of approximately 200 bar to 221 bar. However, those measures take into account primarily the temperature trend in the vertical direction of the combustion chamber.

A compensation of the temperature trend in the horizontal direction, and therefore a good heating balance, is achieved in the case of the helical tubing of the combustion chamber (spiral winding), since each evaporator tube or parallel tube runs virtually through all of the heating zones of the combustion chamber. However, in comparison with vertical tubing, due to comparatively small inlet surfaces of the evaporator tubes and therefore a comparatively small total number of evaporator tubes, the spiral winding leads to higher velocities of the flow medium in the evaporator tubes. That leads, in turn, to a comparatively high water-side/steam-side pressure loss.

SUMMARY OF THE INVENTION

It is accordingly an object of the invention to provide a continuous-flow steam generator, which overcomes the herein afore-mentioned disadvantages of the heretofore-known devices of this general type, which is constructed for high thermal efficiencies, which has combustion-chamber walls with vertical tubing and in which temperature differences at an evaporator outlet are reduced to particularly low values.

With the foregoing and other objects in view there is provided, in accordance with the invention, a continuous-flow steam generator, comprising a combustion chamber having a rectangular cross-section with corners and having combustion-chamber walls with middle regions; each of the combustion-chamber walls having substantially vertically disposed evaporator tubes for upwardly conducting a flowing medium from bottom to top, and tube webs gas-tightly interconnecting the evaporator tubes; and each of the evaporator tubes and at least one of the tube webs connected thereto defining a heat-absorbing surface, the heat-absorbing surfaces being smaller in the middle region of the combustion-chamber wall than at the corners of the combustion chamber.

The invention proceeds from the consideration that the heat absorption of the evaporator tubes takes place not only through the gas-side half of the tube periphery, but also through the tube webs or tube fins. Thus, the heat absorbed even by the uncooled tube webs is dissipated to the adjacent evaporator tubes. The heat-absorbing surface of an individual evaporator tube is therefore composed of the half periphery of the evaporator tube facing the flame body inside the combustion chamber and of the surface of a tube web. The surface of a tube web is obtained from the total width of a tube web or from twice the half width of two tube webs or from its length in the vertical direction.

In accordance with another feature of the invention, in order to match the thus defined heat-absorbing surfaces of the individual evaporator tubes at least approximately to the temperature trend in the horizontal direction, the width of the tube webs connecting the evaporator tubes is smaller in the middle region of each combustion-chamber wall than in the corners of the combustion chamber.

In accordance with a further feature of the invention, at the same time, the width of the tube webs increases successively, starting from the middle region, towards the corners of the combustion chamber.

In accordance with an alternative feature of the invention, the evaporator tubes of each combustion-chamber wall are combined into groups having tube webs of identical width, while the widths of the tube webs of different groups are different. In practice, this alternative is simpler to carry out than the first-mentioned alternative.

In accordance with an added feature of the invention, the widths of the tube webs of groups adjacent the corners of each combustion-chamber wall is identical. In this way, the production of combustion-chamber walls with vertically disposed evaporator tubes and with tube webs of differing width can be expediently simplified.

In accordance with an additional feature of the invention, the evaporator tubes in the region of the corners of the combustion chamber can have additional tube webs which project into the combustion chamber, in order to additionally increase the heat-absorbing surface in the region of the corners of the combustion chamber, in relation to the middle region.

In a continuous-flow steam generator which is operated by sliding pressure and in which the pump pressure is governed by the steam quantity required, so-called smooth tubes having a smooth inner surface are expediently employed. However, in accordance with an alternative feature of the invention, internally ribbed tubes can also be used.

In accordance with a concomitant feature of the invention, in the case of both smooth tubes and internally ribbed evaporator tubes, a variation in the inside diameter of the tube and/or the outside diameter of the tube can additionally equalize the differing supply of heat of an individual evaporator tube. An evaporator tube with a diameter larger than that of an evaporator tube in the middle of a combustion chamber wall is then used in a corner of the combustion chamber.

The advantages achieved through the use of the invention are, in particular, that the differing supply of heat into the individual evaporator tubes is equalized by a reduction in the heat-absorbing surface in the middle region of the combustion-chamber walls in contrast to the corners of the combustion chamber. Since the width of the tube webs or tube fins between the evaporator tubes is not identical over the entire combustion-chamber circumference, as heretofore, but is selected to be smaller in the middle of the walls than in the combustion-chamber corners, the heat-absorbing surface for each individual evaporator tube decreases in the middle of the walls and increases in the corners. The heat absorption of the individual evaporator tubes correspondingly decreases and increases respectively. As a result, the high supply of heat into an evaporator tube located in the middle of a combustion-chamber wall is reduced and the lower supply of heat into an evaporator tube disposed in the corner of the combustion-chamber wall is increased.

Other features which are considered as characteristic for the invention are set forth in the appended claims.

Although the invention is illustrated and described herein as embodied in a continuous-flow steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
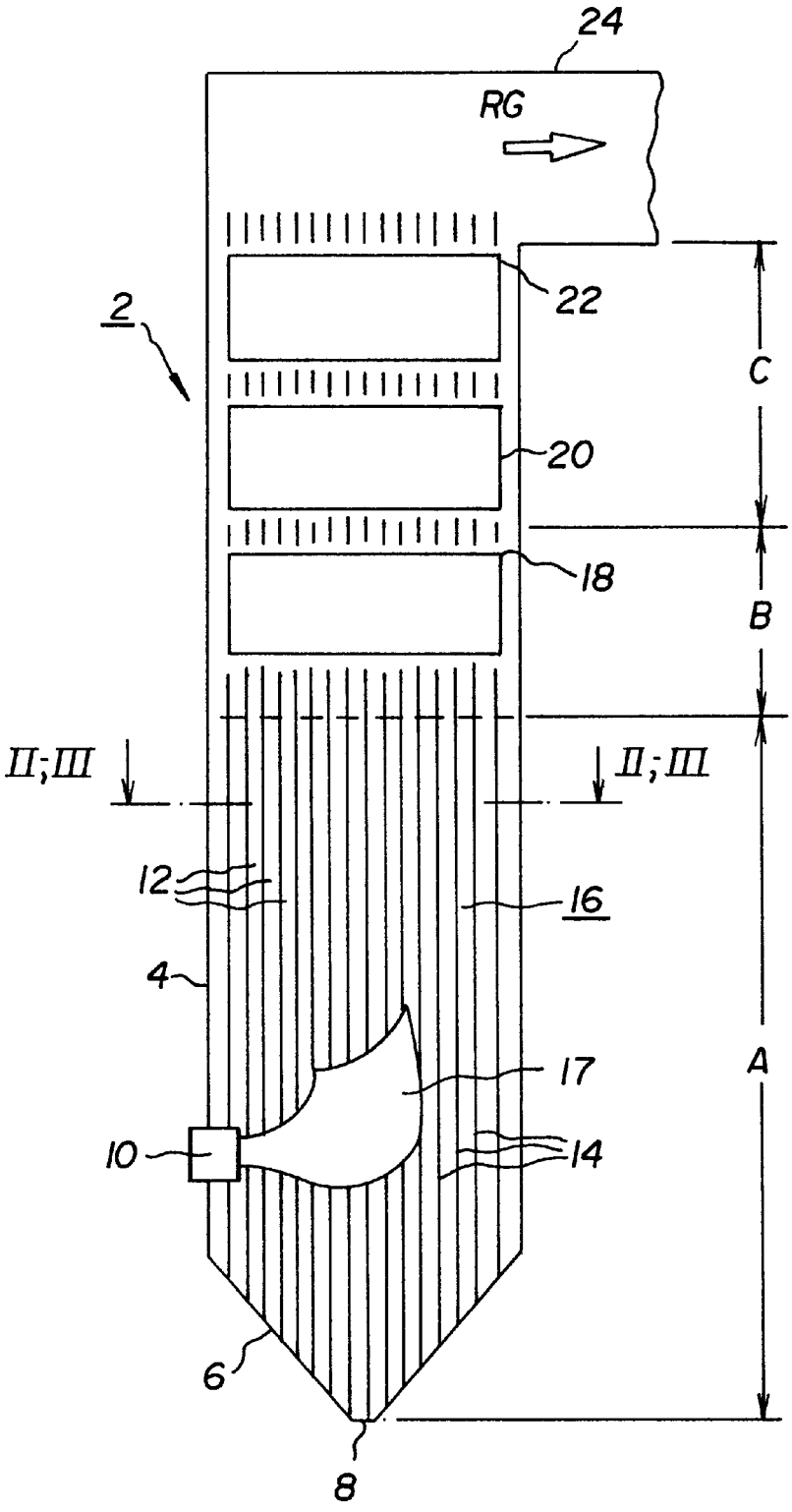
FIG. 1 is a fragmentary, diagrammatic, simplified vertical-sectional view of a continuous-flow steam generator with vertically disposed evaporator tubes.

Referring now in detail to the figures of the drawings, in which parts corresponding to one another are provided with the same reference symbols, and first, particularly, to FIG. 1 thereof, there is seen a continuous-flow steam generator 2 having a rectangular cross-section and a vertical gas flue which is formed from a containing wall of a combustion chamber 4 that merges at a lower end into a funnel-shaped bottom 6. The bottom 6 includes a diagrammatically illustrated discharge orifice 8 for ash.

Figure 2:
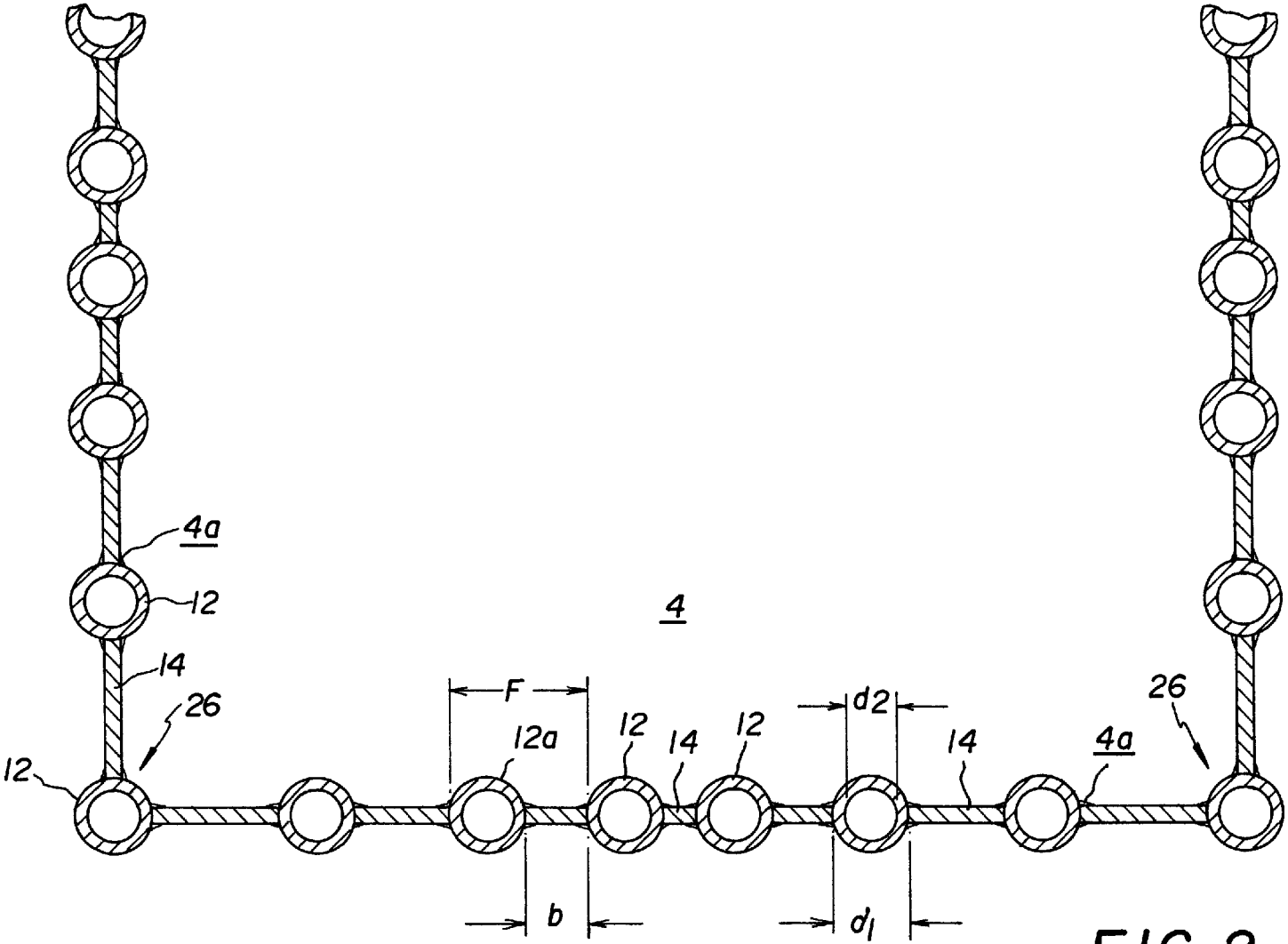
FIG. 2 is an enlarged, fragmentary, cross-sectional view of gas-tight combustion chamber walls having tube webs of differing width, which is taken along a line II—II of FIG. 1 in the direction of the arrows.
Figure 3:
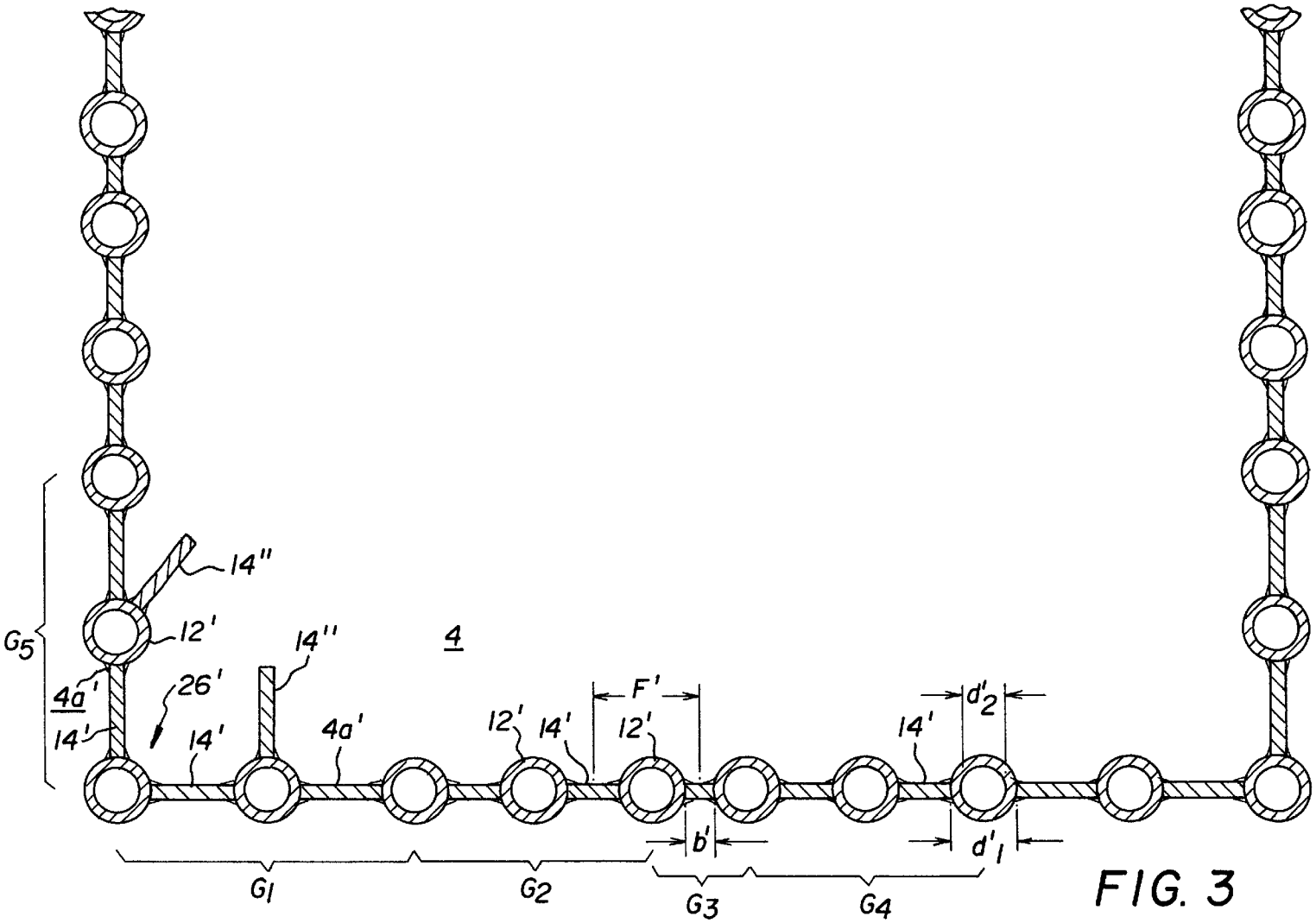
FIG. 3 is a view similar to FIG. 2 with groups of evaporator tubes having web widths that are identical from group to group, which is taken along a line III—III of FIG. 1 in the direction of the arrows.

In a first lower region A of the gas flue, a number of fossil fuel burners 10, only one of which can be seen, are mounted in the containing wall of the combustion chamber 4, which is formed from vertically disposed evaporator tubes 12. As is best seen in FIGS. 2 and 3, the vertically disposed evaporator tubes 12 are welded to one another in this region A by tube fins or tube webs 14 in the form of metal bands, in order to form gas-tight combustion-chamber walls 4*a*. The evaporator tubes 12, through which the flow passes from the bottom upwards when the continuous-flow steam generator 2 is in operation, form an evaporator heating surface 16 in this region A.

When the continuous-flow steam generator 2 is in operation, a flame body 17 occurring during the combustion of the fossil fuel is located in the combustion chamber 4, so that this region A of the continuous-flow steam generator 2 is distinguished by a very high heat flow density. The flame body 17 has a temperature profile which, starting from approximately the middle of the combustion chamber 4, decreases both in the vertical direction upwards and downwards and in the horizontal direction towards the sides, that is to say towards corners of the combustion chamber 4.

A second region B of the gas flue, which is located above the first lower region A, is remote from the flame, and a third upper region C of the gas flue is provided above the second region B. Convection heating surfaces 18, 20 and 22 are disposed in the regions B and C of the gas flue. Located above the region C of the gas flue is a smoke-gas outlet channel 24, through which flue gas RG generated as a result of the combustion of the fossil fuel leaves the vertical gas flue.

Figure 4:
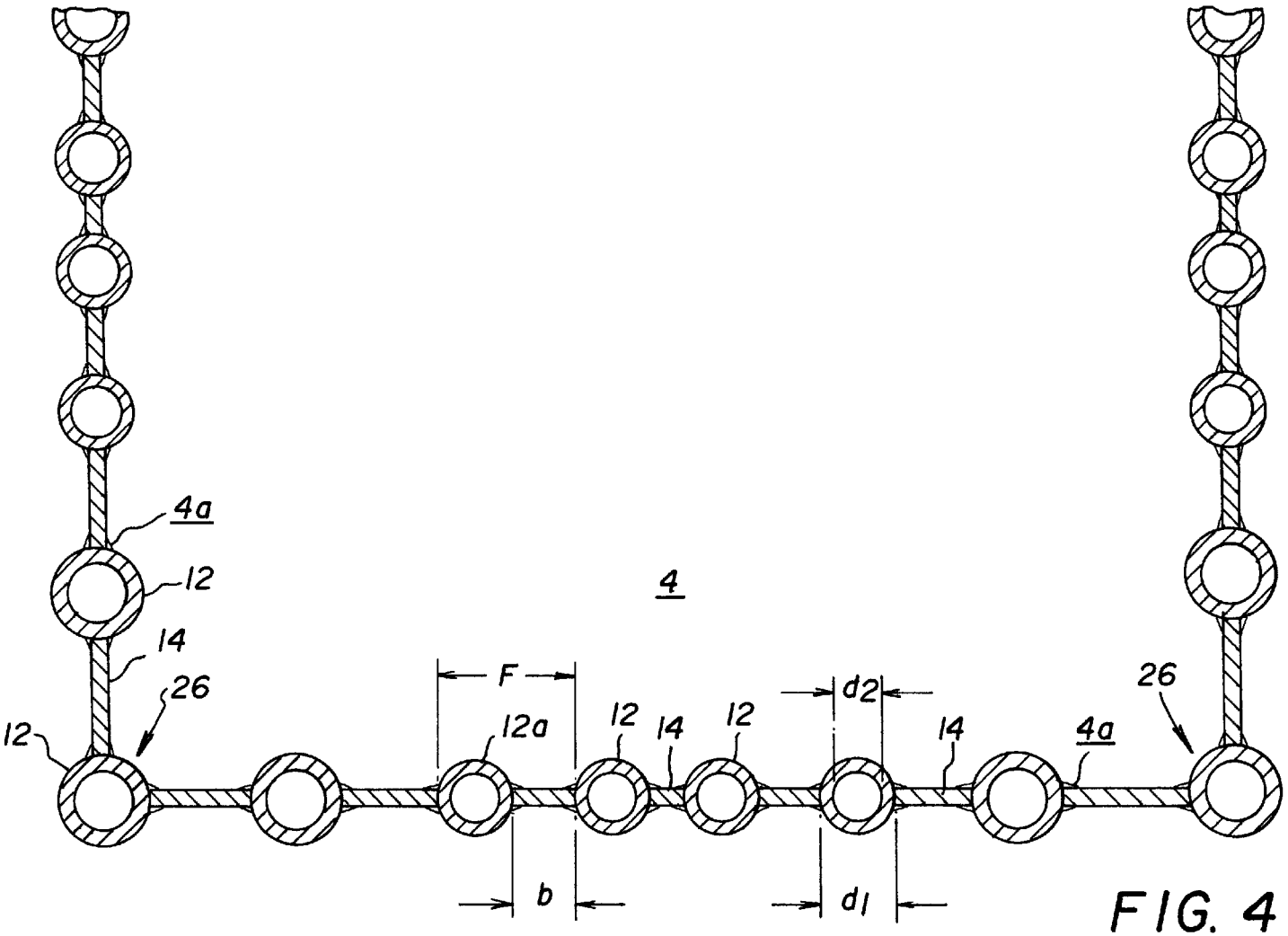
FIG. 4 is an enlarged, fragmentary, cross-sectional view of gas-tight combustion chamber walls having evaporator tubes with different diameters.

FIGS. 2 and 3 each show a portion of a cross-section through the combustion chamber 4 in the region A of the gas flue. Two of the combustion-chamber walls 4*a* in FIG. 2 and 4*a*' in FIG. 3 adjacent a corner 26 are shown. In order to form the gas-tight combustion-chamber walls 4*a*, 4*a*', the tube webs 14 and 14' provided between adjacent evaporator tubes 12, 12' are welded to the evaporator tubes on longitudinal sides. This construction is also referred to as tube-web-tube construction.

The tube webs 14, 14' have a width b, b' corresponding to a respective distance between adjacent evaporator tubes 12, 12'. In a continuous-flow steam generator 2 with a power of 600 MW, each combustion-chamber wall 4*a*, 4*a*' is constructed from approximately 360 evaporator tubes 12, 12'. With an outside diameter $d_1$, $d_1'$ of the evaporator tubes 12, 12' of approximately 30 mm and with a width b, b' of the tube webs 14, 14' of approximately 20 mm, a total width of each combustion-chamber wall 4*a*, 4*a*' of approximately 20 m is obtained.

A heat-absorbing surface F of the respective evaporator tube 12 is obtained from the width b of the tube webs 14, a half circumference 12*a* of the evaporator tube 12 as well as its length. This is illustrated in FIG. 2 by reference to an individual evaporator tube 12.

As is likewise illustrated with reference to an individual evaporator tube 12' in FIG. 3, a heat-absorbing surface F' is also obtained in each case from half the width b' of two tube webs 14' adjacent the evaporator tube 12' and, once again, the half circumference of the individual evaporator tube 12' and its length This latter definition is based on the consideration that, on one hand, the temperature of each tube web 14, 14' has a maximum value at half its width b, b', that is to say in the middle of the tube web 14, 14', and decreases towards the two adjacent evaporator tubes 12 and 12'. On the other hand, each tube web 14, 14' dissipates half its heat to each of the two adjacent evaporator tubes 12 and 12'.

In the exemplary embodiment according to FIG. 2, the width b of the tube webs 14 between the evaporator tubes 12 increases gradually, that is to say little by little, from the middle of each combustion-chamber wall 4*a* towards each corner 26 of the combustion chamber 4. Thus, with an identical length of the evaporator tubes 12 and tube webs 14, the heat-absorbing surface F of the individual evaporator tubes 12 increases continuously from the middle of each combustion-chamber wall 4*a* towards each corner 26 of the combustion chamber 4. Therefore, as a result of the reduction in the fin width b, with an identical supply of heat per unit area, the heat absorption per evaporator tube 12 increases. A higher heat-flow density caused thereby on the outside of the evaporator tube 12 leads to an increased amount of heat on the inside of the evaporator tube 12. As a result, both the local heat-flow density and, over the total height of the continuous-flow steam generator 2, the integral heat-flow density, increase. This leads to good local cooling of the evaporator tubes 12.

In the exemplary embodiment according to FIG. 3, the evaporator tubes 12' of each combustion-chamber wall 4*a*' are combined into groups G1 to G4 with tube webs 14' of identical width b' in each case. At the same time, the width b' of the tube webs 14' of different groups G1, G2, G3 and G4 is different. The width b' of the tube webs 14' of those groups which are adjacent the corner 26' of the combustion chamber 4 is preferably identical. In the exemplary embodiment, these are the tube webs 14' of the group G1 and of a group G5 of the two combustion-chamber walls 4*a*' adjacent the corner 26'.

As is shown only in the exemplary embodiment according to FIG. 3, the evaporator tubes 12' of the combustion chamber 4 which are disposed in the vicinity of the corner 26' have additional tube webs 14" which project with a differing inclination into the combustion chamber 4.

The evaporator tubes 12 and 12' illustrated in the exemplary embodiments according to FIGS. 2 and 3 are smooth tubes with a smooth surface on the inside. Alternatively, however, the evaporator tubes 12, 12' can also have non-illustrated ribs on their inside forming a multiple thread and therefore a surface structure. In the case of the tubing of the combustion-chamber walls 4*a*, 4*a*' of the continuous-flow steam generator 2 with internally ribbed evaporator tubes 12 and 12' of this type, a swirl is superposed on the axial flow in the evaporator tubes 12, 12', so that a particularly good cooling effect of the evaporator tubes 12, 12' is achieved through the use of an additional velocity component caused thereby. This has a particularly advantageous effect in the critical pressure range around approximately 210 bar when the continuous-flow steam generator 2 is in operation.

Both when smooth tubes are employed and when internally ribbed evaporator tubes are used, a variation in the outside diameter $d_1$, $d_1$ and/or an inside diameter $d_2$, $d'_2$ of the evaporator tubes 12, 12' leads to heat-absorbing surfaces F, F' of differing size for the respective evaporator tube 12, 12', so that the differing supply of heat into the individual evaporator tubes 12, 12' can be compensated additionally or alternatively At the same time, the heat-absorbing surface F, F' decreases with a decreasing diameter $d_1$, $d'_1$ or $d_2$, $d'_2$.

I claim:

1. A continuous-flow steam generator, comprising:

a combustion chamber having a rectangular cross-section with corners and having combustion-chamber walls with middle regions;

each of said combustion-chamber walls having substantially vertically disposed evaporator tubes for upwardly conducting a flowing medium, and tube webs gas-tightly interconnecting said evaporator tubes; and each of said evaporator tubes and at least one of said tube webs connected thereto defining a heat-absorbing surface, said heat-absorbing surfaces being smaller in said middle region of said combustion-chamber wall than at said corners of said combustion chamber.

2. The continuous-flow steam generator according to claim 1, wherein said tube-webs interconnecting said evaporator tubes in said middle region of each combustion chamber wall have smaller widths than at said corners of said combustion chamber.

3. The continuous-flow steam generator according to claim 2, wherein said widths of said tube webs are successively increased, as seen from said middle region towards each of said corners of said combustion chamber.

4. The continuous-flow steam generator according to claim 2, wherein said evaporator tubes of each of said combustion-chamber walls are combined into groups, said tube webs within each of said groups have an identical width, and said tube webs of different groups are different.

5. The continuous-flow steam generator according to claim 4, wherein said tube webs of said groups adjacent said corners of said combustion chamber have an identical width.

6. The continuous-flow steam generator according to claim 1, including additional tube webs connected to said evaporator tubes and projecting into said combustion chamber, at least in the vicinity of said corners of said combustion chamber.

7. The continuous-flow steam generator according to claim 1, wherein said evaporator tubes have an inner surface structure.

8. The continuous-flow steam generator according to claim 1, wherein said evaporator tubes in the vicinity of said corners of said combustion chamber have a larger outside diameter and a larger inside diameter than said evaporator tubes in said middle region of said combustion chamber walls.

9. The continuous-flow steam generator according to claim 1, wherein said evaporator tubes in the vicinity of said corners of said combustion chamber have a larger outside diameter than said evaporator tubes in said middle region of said combustion chamber walls.

10. The continuous-flow steam generator according to claim 1, wherein said evaporator tubes in the vicinity of said corners of said combustion chamber have a larger inside diameter than said evaporator tubes in said middle region of said combustion chamber walls.

* * * * *